United States Patent [19]

Chen

[11] Patent Number: 4,754,378

[45] Date of Patent: Jun. 28, 1988

[54] ELECTRIC TORCH

[76] Inventor: Sen-yuan Chen, P.O. Box 10780, Taipei, Taiwan

[21] Appl. No.: 18,640

[22] Filed: Feb. 25, 1987

[51] Int. Cl.[4] ..... F01L 7/00

[52] U.S. Cl. ..... 362/196; 362/200

[58] Field of Search ..... 362/187, 196, 200, 208

[56] References Cited

U.S. PATENT DOCUMENTS

| | | | |
|---|---|---|---|
| 1,264,525 | 4/1918 | Kahn | 362/200 |
| 2,591,112 | 4/1952 | Zwierzynski | 362/196 |
| 4,400,763 | 8/1983 | Kribs et al. | 362/200 |
| 4,432,041 | 2/1984 | Pfisterer et al. | 362/200 |
| 4,438,483 | 3/1984 | Gulliksen et al. | 362/200 |

FOREIGN PATENT DOCUMENTS

| | | | |
|---|---|---|---|
| 341239 | 7/1920 | Fed. Rep. of Germany | 362/200 |
| 730950 | 8/1932 | France | 362/200 |
| 494810 | 11/1938 | United Kingdom | 362/200 |
| 1017139 | 1/1966 | United Kingdom | 362/200 |

*Primary Examiner*—Charles J. Myhre
*Assistant Examiner*—David A. Okonsky
*Attorney, Agent, or Firm*—Armstrong, Nikaido, Marmelstein & Kubovcik

[57] ABSTRACT

This invention having a torch body and an assembled cover to form an inner room which contains a PC Board, bulb holder and batteries; a button switch attached on the face of the torch cover with a L-arm part with a current conducting plate at the front end able to be connected to the PC Board; a light shade having a convex lens on its upper shell and with a lower shell made of diaphanous material; the PC Board with two diodes and one condenser to form an unstable oscillator is served to be an electric torch, flash warning tool and magnifying glass.

5 Claims, 2 Drawing Sheets

ELECTRIC TORCH

BRIEF SUMMARY OF THE INVENTION

An electric torch with no screw or rivet fittings to assemble its body has illuminating, flash warning and vision magnifying functions by including a torch body, an assembled cover, a button switch with one current conducting plate to control a PC Board in the torch body, a light shade with convex lens and with its lower shell in diaphanous material, two batteries and one PC Board in the torch body, and a clamp on the outer face of the torch body for clipping on the edge of pocket.

BACKGROUND OF THE INVENTION

Electric torches in general market has following shortcomings:

1. Rather complicated structure by welding, screwing or riveting each fitting and uneasy to assemble all parts to be a torch.
2. Unique function for illuminating.
3. Inconvenient for carrying or storing.

In recent days an unstable oscillator is widely used in warning signal designs but we still could not find a handy device which is free from any screw or rivet fittings to assemble its body, nor concurrently served as a torch and a flash warning signal.

PURPOSE OF THE INVENTION

The main purpose of this invention is to offer a handy electric torch which is easy to be assembled, produced, and repaired by having all these simple fittings. Secondly, this invention is easy to be carried by hand, deposited on a certain place, clipped on a pocket, and hanged at a higher position. Thirdly, this invention is designed to have illuminating and flash light functions. Fourly, this invention is designed as a magnifying glass for general purpose.

To attain all these purposes, this invention includes a torch body, an assembled cover which might be formed an inner room for containing a bulb holder, a PC Board with an unstable oscillator device and batteries. A button switch attached on the face of the torch cover is able to be moved along the way of a recess hole of the cover and connected to the junctions on a PC Board by having a current conducting plate at the front end of its L-arm part. A convex lens is fixed on the light shade of this invention and a clamp is located on the outer face of the torch body.

DETAIL DESCRIPTION OF THE INVENTION

Figure 1:
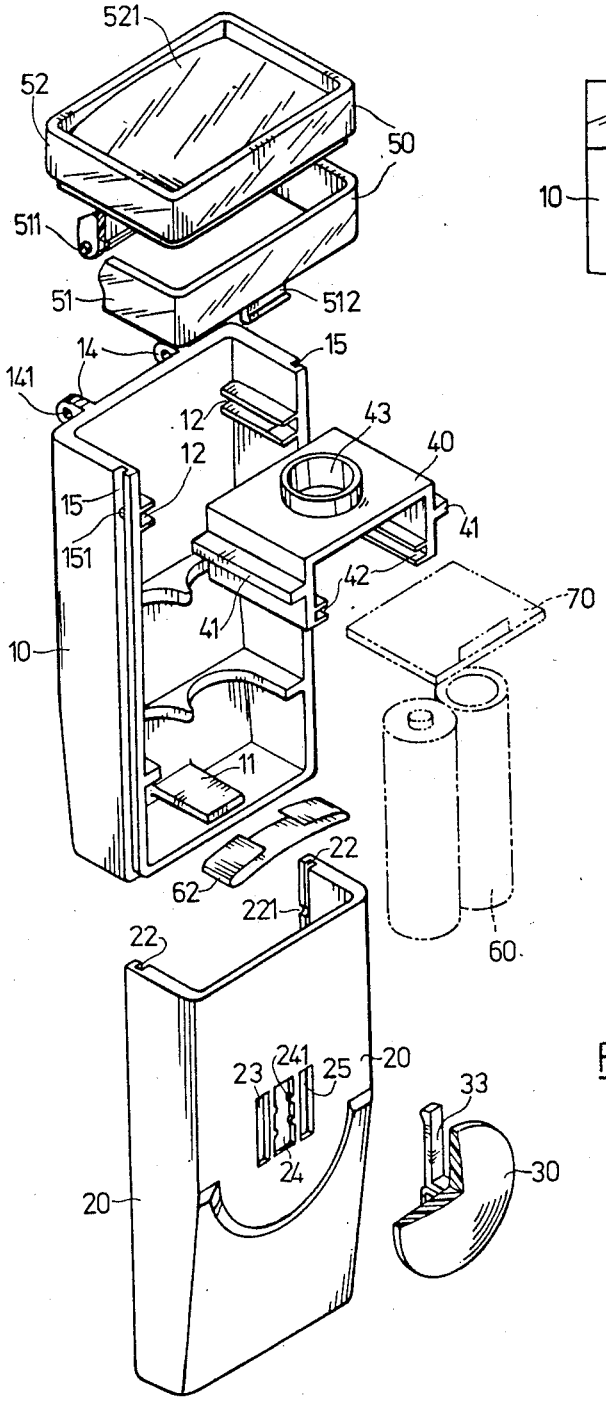
FIG. 1 is a disassembled and perspective view of this invention.
Figure 2:
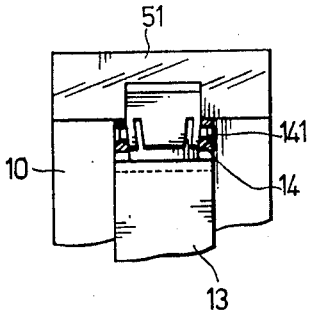
FIG. 2 is a part sectional rear view to show a light shade and torch body of this invention.
Figure 3:
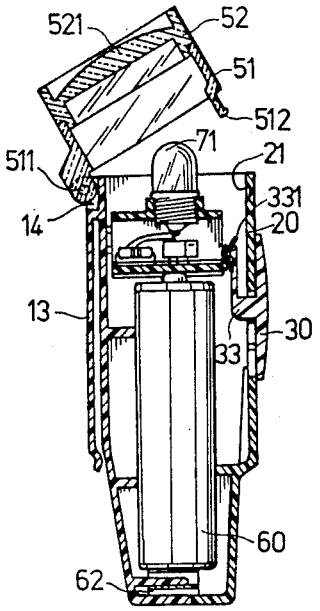
FIG. 3 is a sectional and assembled view of this invention.
Figure 4:
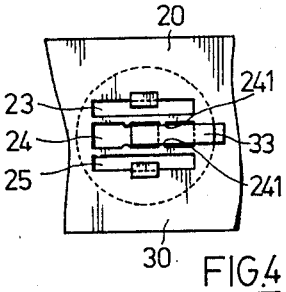
FIG. 4 is a part frontal view to show a button switch of this invention.
Figure 5:
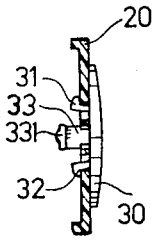
FIG. 5 is sectional side view to show the button switch of this invention.
Figure 6:
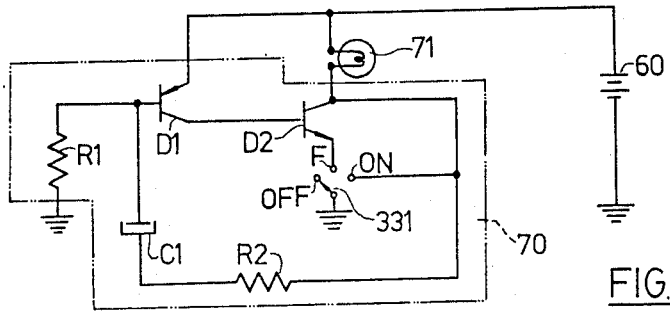
FIG. 6 is a printed circuit view of this invention.

This invention includes a torch body 10, an assembled cover 20, a button switch 30, a bulb holder 40, a light shade 50, a pair of batteries 60 and a PC Board 70. Torch body 10 is able to be assembled with cover 20 to form an inner room which might be contained a pair of batteries 60 and a piece of copper board 62 on its scarfed plate 11 by connecting batteries in series method. Rail 12 scarfed on both sides of upper part of body 10 is formed to fix bulb holder 40 by joggling flange 41 of the holder. Rail 42 scarfed on the inner wall of bulb holder 40 is designed to fix PC Board 70. As FIG. 6 illustrates, PC Board 70 has two diodes D1 and D2, two resistances R1 and R2, and one condensor C1 where power is supplied by batteries 60 and bulb 71 is installed in hole 43 of the holder 40. At the rear side of body 10, clamp 13 and sockets 14 are formed as a part of the body. Lower shell 51 of light shade 50 is made by any diaphanous material in yellow or other colors and is matched with an upper shell 52 with convex lens 521 and is able to be lifted up or pressed down in a certain circle range by scarfing its projecting shaft 511 with sockets 14 of the body. As FIG. 3 shows, when light shade 50 has been lifted up, convex lens 521 is served to be a magnifying glass for general purpose. When light shade 50 has been pressed down and matched with body 10 by scarfing flange 512 of lower shell 51 with notch 21 of cover 20, this invention is served to be an electric torch. Rail 15 located at the top edge of body 10 with a projecting ball 151 on the proper position is served to assemble body 10 with cover 20 and to form an inner room by matching flute 22 of cover 20 and fixing its projecting ball 151 with notch 221 of cover 20. Three recess holes 23, 24 and 25 are parallelly placed on the face of cover 20 and hole 24 has one pair of inward projecting spots 241 on each flank to trisect its length. At the lower flange of button 30, clips 31 and 32 are managed to be attached on cover 20 by stretching to hook the other face of the said cover via hole 23 and 25. L-arm 33 of button 30 having its vertical part in $\frac{1}{3}$ square large of hole 24 and in proper length to extend through cover 20 is able to be moved along the hole as a treplexing switch. Current conducting plate 331 located at the end of the horizontal part of L-arm 33 is served to be connected alternatively with ON, FLASH LIGHT, or OFF junction on the PC Board 70. As FIG. 6 illustrates when ON is connected with conducting plate 331, bulb 71 would be lit. When F is connected with conducting plate 331, bulb 71 would be flashed where diodes D1 and D2 with condensor C1 are formed as an unstable oscillator, OFF means to turn off the power supply from batteries. As stated above, this invention apparently shows the following funtions:

1. An apparatus for illuminating, flash warning and object magnifying purposes.
2. Easy to be assembled without any screw fittings.
3. A handy tool to be clipped on the edge of a pocket with clamp 13.
4. Easy to replace batteries and bulb.

I claim:

1. An electric torch including a torch body with a pair of shaft sockets to attach a light shade, an inner rail to support a bulb holder and an outer top rail to attach a cover to thereby form an inner room, said cover having a matching flute cooperating with said outer top rail for attachment of said cover to said torch body thereby forming said inner room for housing said bulb holder, batteries and a PC Board; a lamp bulb, electrical connecting means for connecting said batteries to said PC Board and said bulb, said electrical connecting means including a button switch; three recess holes to attach said button switch, said switch having two clips and one L-arm, said L-arm having secured thereon a current conducting plate at a remote end of the horizontal part of the L-arm to select junctions on the PC Board which result in different functions; said bulb holder having an inner rail to support the PC Board and an aperture for passage of said bulb; and light shade having a pair of projecting shaft portions for attachment to said respective shaft sockets; said PC Board having with one junction for steady state illumination and a second junction to form an unstable oscillator.

2. An electric torch in accordance with claim 1 wherein said unstable oscillator is formed by two diodes and one condenser on the PC Board.

3. An electric torch in accordance with claim 1 wherein a convex lens is fixed on the light shade.

4. An electric torch in accordance with claim 1 wherein a lower shell of the light shade is made of diaphanous material with color.

5. An electric torch in accordance with claim 1 wherein a clamp device is located on an outer face of the torch body for clipping onto an edge of a pocket.

* * * * *